US005483983A

United States Patent [19]

Briggs et al.

[11] Patent Number: 5,483,983

[45] Date of Patent: Jan. 16, 1996

[54] DUAL PURPOSE CLEANING TRAY FOR LOT BOX CLEANING MACHINE

[75] Inventors: Keith O. Briggs, San Antonio; John J. Perez, Lubbock; Gregory A. Taylor, San Antonio, all of Tex.

[73] Assignees: Sony Corporation, Tokyo, Japan; Sony Electronics Inc., Park Ridge, N.J.

[21] Appl. No.: 240,527

[22] Filed: May 10, 1994

[51] Int. Cl.[6] ..... B08B 13/00

[52] U.S. Cl. ..... 134/58 R; 134/95.1; 134/201; 211/181; 220/486; 422/300

[58] Field of Search ..... 211/181, 41; 220/486, 220/487, 488; 422/300; 134/92, 135, 159, 198, 199, 200, 201, 95.2, 58 R, 95.1; 99/403

[56] References Cited

U.S. PATENT DOCUMENTS

| | | | |
|---|---|---|---|
| 557,706 | 4/1896 | Rivierre | 220/486 X |
| 2,184,245 | 12/1939 | Watral | 211/181 X |
| 2,586,005 | 2/1952 | Colonna | 220/487 |
| 4,189,056 | 2/1980 | Majewski | 211/181 X |
| 4,732,291 | 3/1988 | McConnell | 220/488 |
| 4,830,200 | 5/1989 | Zambano et al. | 211/181 |
| 4,836,392 | 6/1989 | Constantino | 211/181 |
| 5,209,784 | 5/1993 | Bellman | 134/135 X |

*Primary Examiner*—Philip R. Coe
*Attorney, Agent, or Firm*—Ronald P. Kananen

[57] ABSTRACT

In order to clean reticle boxes in the same manner as lot boxes and the like type of container, the framework of a basket which is used to support containers such as the lot boxes, is modified in a manner which allows reticle boxes to be additionally disposed therein. This modified basket allows both types of boxes to be cleaned at the same time by a specialized cleaning machine which makes use of distilled de-ionized water, surfactant, clean air and the like type of fluids, for washing and drying purposes.

3 Claims, 3 Drawing Sheets

DUAL PURPOSE CLEANING TRAY FOR LOT BOX CLEANING MACHINE

BACKGROUND OF THE INVENTION

1. Field of the Invention

The present invention relates generally to a cleaning arrangement for reticle boxes. More specifically, the present invention relates to a tray for a lot box cleaning device which has been modified to enable both reticle boxes and lot boxes to be supported and cleaned under the same conditions.

2. Description of the Relevant Art

Reticles are important devices used in the manufacture of semiconductor devices. However, in order to achieve the required production precision, it is essential that all equipment is meticulously cleaned on a regular basis and constantly maintained in a scrupulously clean state.

For example, the lot boxes in which IC's are placed are cleaned in a specialized cleaning apparatus which is adapted to receive and clean such arrangements. However, at this time the boxes in which reticles (masking devices used in the production of the IC chips) are placed, are cleaned manually with a clean room wiper (i.e. are manually wiped with a clean rag). Until this time little attention has been paid to the cleaning of reticle boxes. Accordingly, a problem exists in that the required level of cleaning and particle removal may not be achieved. Accordingly, the possibility that some particulate matter could be transferred from the box to one or more of the reticles stored therein exists.

SUMMARY OF THE INVENTION

It is an object of the present invention to adapt an existing piece of cleaning equipment in a manner which allows the cleaning of reticle boxes to be automated and carried out in the same manner and/or at the same time as lot boxes.

It is another object of the present invention to adapt a tray of a lot box cleaning machine in a manner which allows a reticle box to be additionally supported by the tray and thus allow cleaning of the box in a cleaning machine designed for lot boxes.

It is a further object of the present invention to provide a tray for a lot box cleaning machine which can support both reticle and lot boxes and thus enable both to be cleaned together.

In brief, the above objects are achieved by an arrangement wherein the framework of a basket which is used to support containers such as the lot boxes, is modified in a manner which allows reticle boxes to be additionally disposed therein. This modified basket allows both types of boxes to be cleaned at the same time by a specialized cleaning machine which makes use of distilled de-ionized water, surfactant, clean air and the like type of fluids, for washing and drying purposes.

More specifically, a first aspect of the present invention resides in a cleaning apparatus which includes a source of fluids under pressure and which features a basket adapted to support at least two different types of container, so that said at least two different types of containers can be cleaned in the same manner and at the same time; and a lid member hingedly mounted on the basket, the hinge member being arranged to be moved to a closed position wherein it closes a mouth of the basket and retains containers disposed in the basket in predetermined positions during the application of pressurized jets of fluid thereagainst during operation of the cleaning apparatus.

A second aspect of the invention resides in a combination which is used in a clean room environment comprising a microcomputer controlled cleaning machine, the cleaning machine being adapted to decontaminate articles which are placed therein; and a tray-like basket for supporting the articles to be decontaminated, the basket having a wire frame including feature means for supporting a first box which is adapted to receive IC chips and a second different sized box which is adapted to receive reticles which are used for the production of the IC chips, the basket having a pivotal lid for retaining the articles in position in the basket during decontamination.

Another aspect of the present invention resides in a basket for use in a cleaning apparatus used in a clean room environment associated with the production of IC components, comprising: a wire frame including a plurality of horizontally extending beams which interconnect side members of the wire frame; a plurality of loop features which are formed on the horizontally extending beams and which are so sized and arranged to enable two different types of box type containers to be supported thereon; and a wire frame lid member pivotally supported on the wire frame for closing the top of the frame and for retaining the containers which are disposed in the wire frame, in predetermined positions during a decontamination operation of the cleaning machine.

BRIEF DESCRIPTION OF THE DRAWINGS

The present invention will become more clearly appreciated as a description of the preferred embodiment is made with reference to the appended drawings in which.

DETAILED DESCRIPTION OF THE PREFERRED EMBODIMENTS

Figure 1:
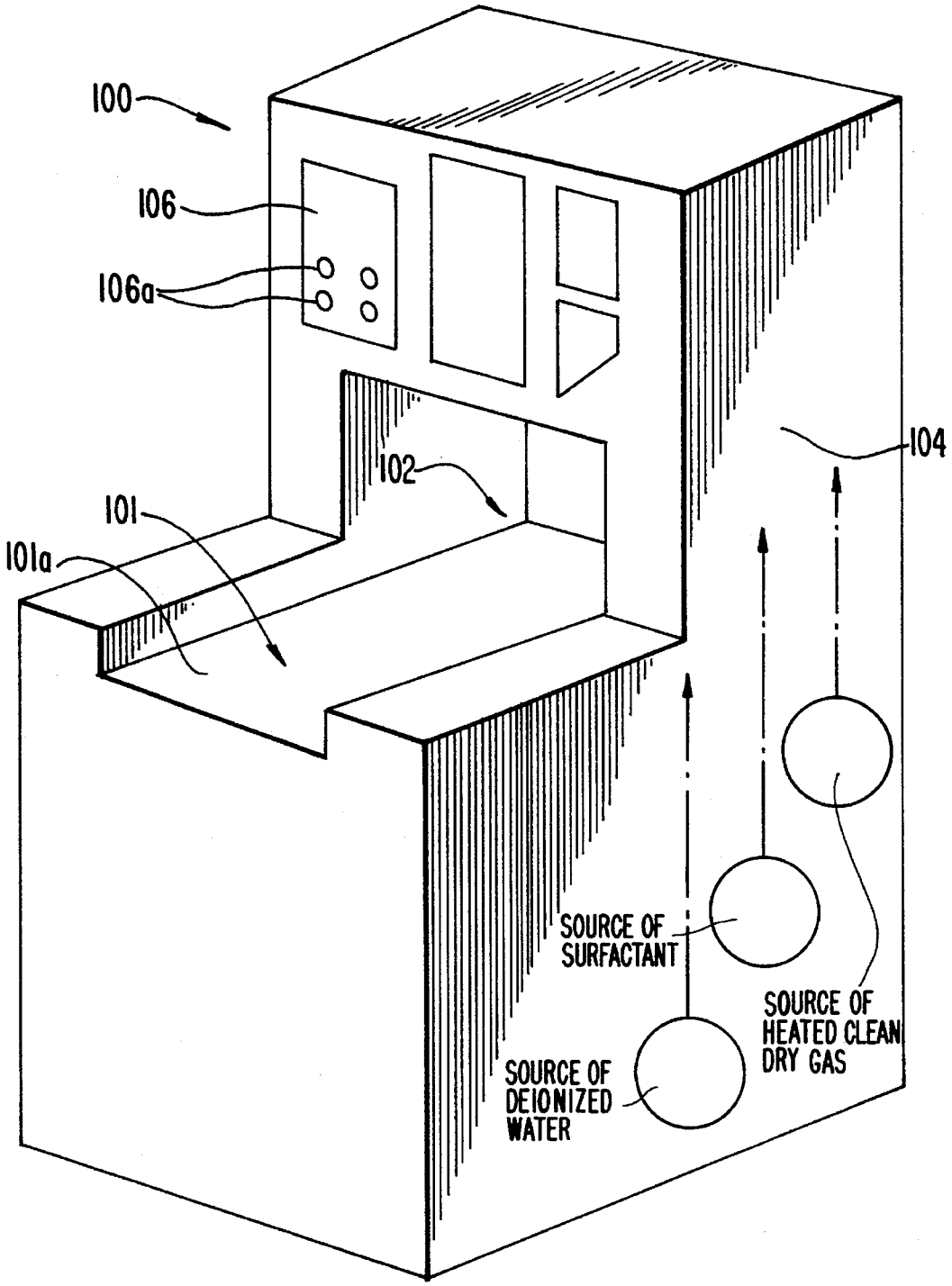
FIG. 1 is a perspective sketch of a cleaning device to which the present invention is applicable.

FIG. 1 shows an example of a cleaning machine to which the present invention may be applied. In this case the machine takes the form of a CRD-2410 type cleaning machine 100 which is an integrated system consisting of a load platform 101, a processing chamber 102, a controller 104, and baskets (not shown in this figure) that hold the items to be cleaned. All components are mounted on a single frame or chassis. This cleaning machine or CRD-2410 as it will be referred to hereinafter, may be provided with a conveyor option on the entrance/exit sides of the machine so as to allow baskets to be automatically fed to and from the CRD-2410.

The standard load platform 101 has three components: a stainless steel table 101*a*, a motor driven conveyor and an anti-static system. A DI water tank, surfactant tank and power distribution unit are located below the load platform 101.

The mainframe contains all the major components involved in the actual decontamination process. The processing chamber 102, with its respective sensors and conveyor system. Above the load platform 101 is the instrument panel 106 and controller providing easy access to the operator. Air heaters, air filters and all solenoid valves related to the pneumatics of the machine are located on top of the processing chamber. The DI water and surfactant solenoid valves and associated filtration units are located below the processing chamber 102.

A controller module, which is mounted on the mainframe, contains the control system that operates the CRD-2410. The nerve center of this system is a Z-80 based microprocessor and associated memory chips. The simply designed instrument panel 106 has four thumbwheel switches 106*a* for setting operational mode, wash, rinse and dry times; two command buttons to START or STOP the machine; and an LED display that allows the operator to check the status of the system.

Operation

After loading a basket with items to be cleaned, the operator loads the basket onto the load platform and presses the START button. The CRD-2410 then proceeds automatically. The operator need only load baskets onto the load platform and remove them after they are processed.

A typical operation of the CRD-2410 is such that the operator loads a basket containing items to be cleaned onto the load platform 101, sets the wash, rinse and dry times then presses the START button on the front panel of the controllers 104. Following this the basket is transported into the processing chamber 102, the doors close and the basket is sprayed with a specially selected non-ionic detergent and DI water and then rinsed with DI water.

Drying is carried out in a two-step process. A high flow rate of heated clean dry air or Nitrogen is used to blow off most of the water, then heated clean dry air is used to evaporate the rest as the conveyor moves the basket back and forth past the nozzle array. When drying is complete the entrance door opens and the cleaned basket returns to the load platform 101. With the conveyor option the exit door drops and the cleaned basket is transported to the exit conveyor. A second basket can then be fed into the system via the load platform.

The wire baskets (316 SS electropolished) are custom built to hold the items. Wash, rinse and dry times can be adjusted over a wide range to match varying requirements.

Because the CRD-2410 is completely automatic, every basket is processed in the same way, and every item is decontaminated to the same high standard.

During normal operation, the CRD-2410 continuously monitors itself to ensure that everything is functioning properly. This is called "Run" mode. The controller 104 uses a network Of sensors to do this. If any abnormal condition occurs, the controller 104 stops the machine and displays a fault code that identifies the problem. In addition, the machine can be put into either of two different diagnostic modes. In the sensor diagnostic mode, the condition of each sensor in the system can be checked from the control panel. In the actuator diagnostic mode., each solenoid valve or motor can be operated individually, or several can be operated simultaneously. These features are extremely useful during set up, adjustment and troubleshooting procedures. If a basket needs to be retrieved from the machine in the middle of a process or after an abnormal condition occurs, the machine can be put in a "clear" mode.

The top and side panels can be removed to give convenient access to the heaters, filters and solenoid valves. The front lower panel can be removed to provide access to the main power switch, fuses and surfactant tank. Cover panels on the rest of the machine can be removed easily if servicing is required.

Figure 2:
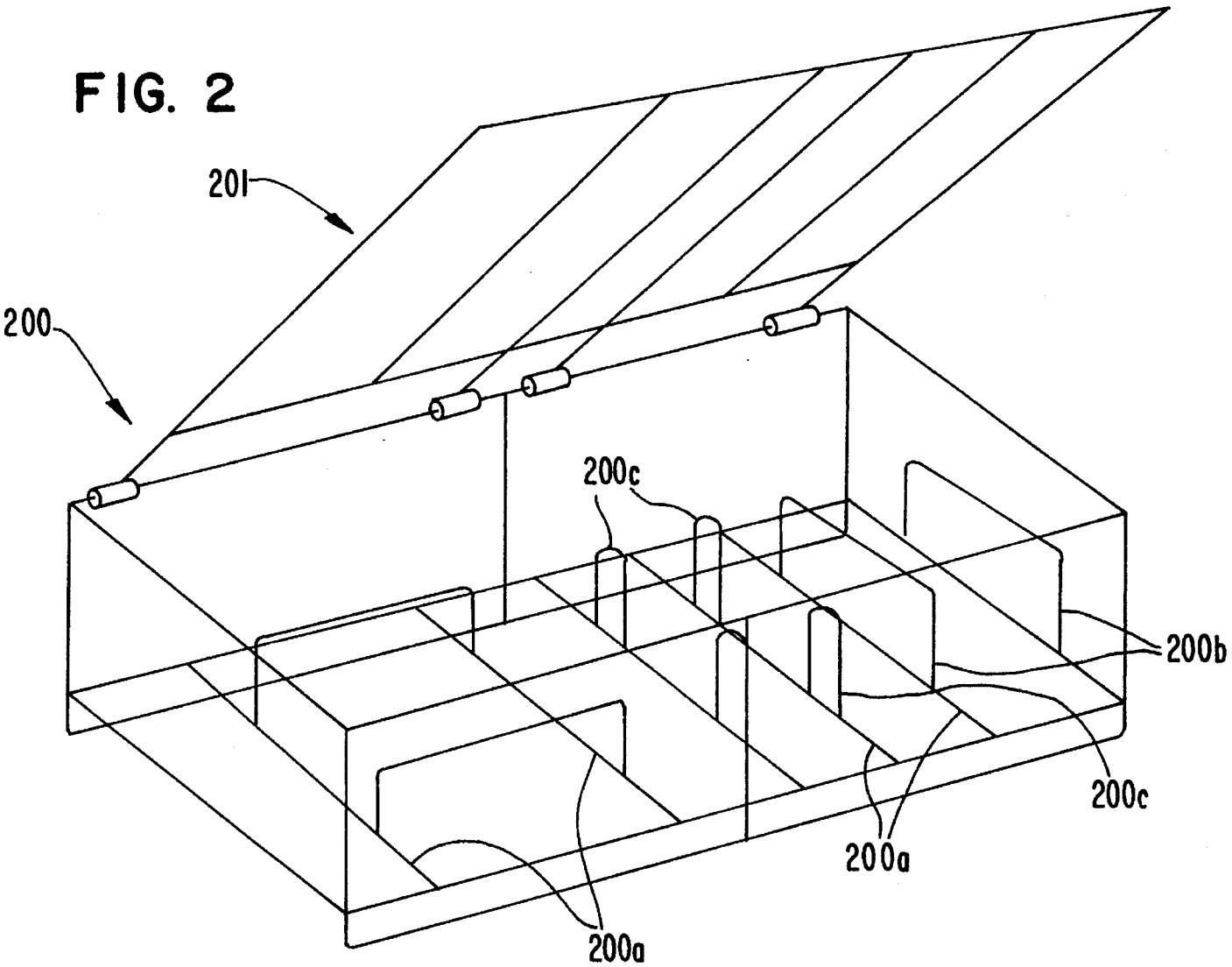
FIG. 2 is a perspective view of a first embodiment of a tray or basket which is designed in accordance with the present invention, to receive both reticle and lot boxes and to be used in the cleaning device depicted in FIG. 1.
Figure 3:
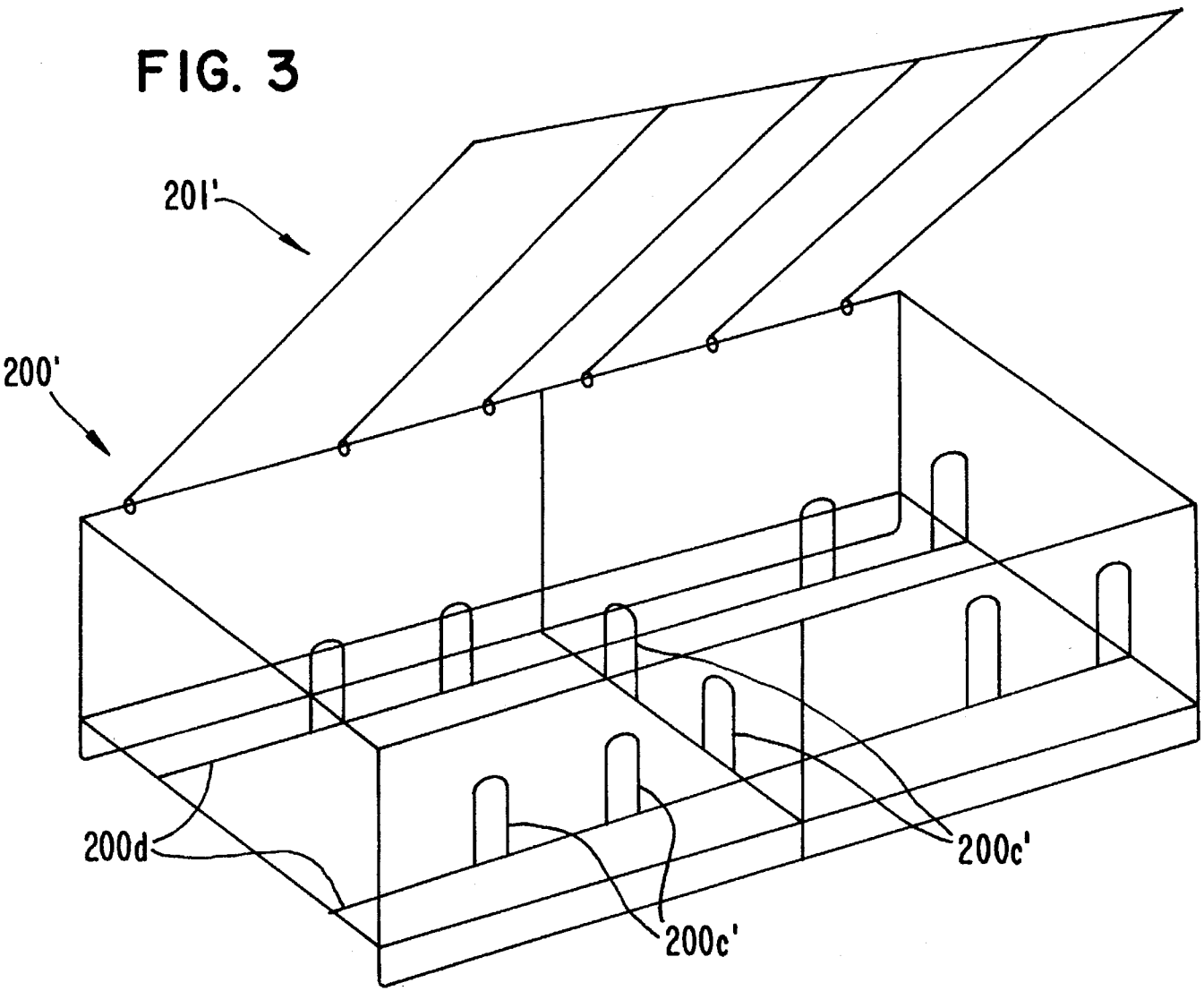
FIG. 3 is a perspective view of a second embodiment of a tray which is adapted to support both reticle and lot boxes and wherein loops are employed in place of the combination of loops and bridges used in the embodiment depicted in FIG. 2.

FIG. 2 shows a basket 200 which characterizes the present invention. As will be appreciated, the basket comprises a wire skeleton having cross-beams 200*a* on which a plurality of bridge and loop features 200*b*, 200*c* are formed. These bridge and loop features 200*b*, 200*c* allow various shaped items such as lot boxes and reticle boxes to be placed in the basket in a manner which assures that complete decontamination of particulate matter and the like will be achieved. As will be noted, some of the bridges 200*b* are arranged to extend laterally across the frame while others extend in the longitudinal direction. The invention is not limited to the use of both bridges 200*b* and loops 200*c* and this combination may be suitably replaced with a support arrangement using only loops 200*c*' in the manner depicted in FIG. 3.

It will be noted that the second embodiment of the frame 200' differs from the first one not only in that loops 200*c*' are used in place of the bridges 200*b*, but, in order to support the loops 200*c*', the cross-beams 200*a* are replaced with longitudinal extending beams 200*d*.

It will be noted that in both of the these embodiments the basket is provided with a hinged lid member 201 which is arranged to swing down from the partially open position illustrated in these figures, and close off the mouth of the basket when in use. The reason for the hinged lid is to ensure that the containers which being cleaned, are not displaced in an undesirable manner by the pressurized jets of fluid which are directed from both above and below the basket during the washing and drying operations.

The framework of both the baskets and lids can be made of 316 electropolished stainless steel or can be Teflon coated if so desired.

What is claimed is:

1. In a clean room environment associated with IC chip production, the combination of:

a microcomputer controlled programmable cleaning machine for clean room equipment, said cleaning machine including:
a source of deionized water,
a source of surfactant, and
a source of heated clean dry gas, said cleaning machine being adapted to decontaminate articles which are placed therein by selectively using deionized water from said source of deionized water, surfactant from said source of surfactant, and heated clean dry gas from said source of heated clean dry gas; and a skeletal wire tray-like basket for supporting the articles to be decontaminated, said basket having a wire frame including:
a plurality of cross-beams,
support means for specifically supporting first boxes which are adapted to receive IC chips and second different sized boxes which are adapted to receive reticles which are used for the production of the IC chips, said support means including a plurality of loop-shaped support members for supporting said first boxes and a plurality of bridge-shaped support members for supporting said second box means, said plurality of bridge-shaped support members being formed on said plurality of cross-beams, and a pivotal lid for retaining the first and second boxes in position in said basket during washing, decontamination and drying operations.

2. A cleaning machine as set forth in claim 1, wherein said skeletal wire tray-like basket is made of electropolished stainless steel.

3. A cleaning machine as set forth in claim 1, wherein said electropolished stainless steel is covered with Teflon.

* * * * *